US005857571A

United States Patent [19]

Tschantz et al.

[11] Patent Number: 5,857,571

[45] Date of Patent: Jan. 12, 1999

[54] INFLATABLE PACKAGING CUSHION

[76] Inventors: Mitchell Tschantz, P.O. Box 40, Newtown, Conn. 06470; Jeffrey Goodner, 1355 S. Inca St., Denver, Colo. 80223

[21] Appl. No.: 980,785

[22] Filed: Dec. 1, 1997

[51] Int. Cl.[6] ..... B65D 81/02

[52] U.S. Cl. ..... 206/522; 383/3

[58] Field of Search ..... 206/521, 522, 206/588, 591, 592; 383/3; 428/71

[56] References Cited

U.S. PATENT DOCUMENTS

| | | | |
|---|---|---|---|
| 5,340,632 | 8/1994 | Chappuis | 206/522 |
| 5,348,157 | 9/1994 | Pozzo | 206/522 |
| 5,445,274 | 8/1995 | Pharo | 206/522 |
| 5,469,966 | 11/1995 | Boyer | 383/3 |
| 5,588,532 | 12/1996 | Pharo | 206/522 |

FOREIGN PATENT DOCUMENTS

| | | | |
|---|---|---|---|
| 2389547 | 1/1979 | France | 206/522 |
| 5-4660 | 1/1993 | Japan | 206/522 |
| 287340 | 2/1965 | Netherlands | 206/522 |

*Primary Examiner*—David T. Fidel
*Attorney, Agent, or Firm*—Edward R. Hyde

[57] ABSTRACT

An inflatable cushion for surrounding a package to be shipped. The cushion is formed of a grid of columns and rows of compartments adopted to be inflated. Selected compartments are sealed against inflation to permit orientation of the cushion and to enhance cushioning effect.

6 Claims, 5 Drawing Sheets

INFLATABLE PACKAGING CUSHION

BACKGROUND OF THE INVENTION

The present invention relates to inflatable cushion packaging material.

In the normal mailing or other transportation items are customarily packaged in an outer container leaving voids betwen the product and its container which must be filled to protect the product during shipment. One manner of filling these voids is by inflatable cushions. An example of such inflatable devices is found in U.S. Pat. No. 5,348,157. As seen in that patent the inflatable cushions can take various forms for surrounding portions of the product being shipped.

The inflatable cushions of the prior art have the disadvantage of being of elaborate designs often requiring openings passing through the cushion and generally being of custom design for a particular product. The present invention on the other hand is of a simple design that is readily and conveniently manufactured and may be utilized for a large variety of shapes and sizes of products being packaged.

SUMMARY OF THE INVENTION

The inflatable cushion of the present invention is in the configuration of a flat raft-like design having rows and columns of individual compartments. Most of the compartments are joined by air passsages so that a single valve would serve to inflate the cushion. Provision is made to conveniently fold the cushion to provide upright sides or a top member so that the cushion will conveniently surround the product being shipped on various surfacs of the product.

In one embodiment of the invention the protected product is surrounded on all sides by an inflatable cushion. The top and bottom cushions each have a section that is noninflated resulting in improved cushioning.

Accordingly, it is a primary object of the present invention to provide an inflatable cushion of simple structure that may be conveniently and economically manufactured.

Another object of the present invention is to provide an inflatable cushion that may be folded or configured to surround all sides of a product for shipment.

A further object of the present invention is to provide a flat inflatable cushion that may be readily folded to surround a product for packaging and shipment.

A further object of the invention is to provide an inflatable cushion in which selected surfaces have both inflated and noninflated portions for improved cushioning.

BRIEF DESCRIPTION OF THE DRAWINGS

The foregoing and still other objects and advantages of the present invention will be more apparent from the following detailed explanation of the preferred embodiments of the invention considered in connection with the accompanying drawings in which.

DESCRIPTION OF THE PREFERRED EMBODIMENTS

Figure 1:
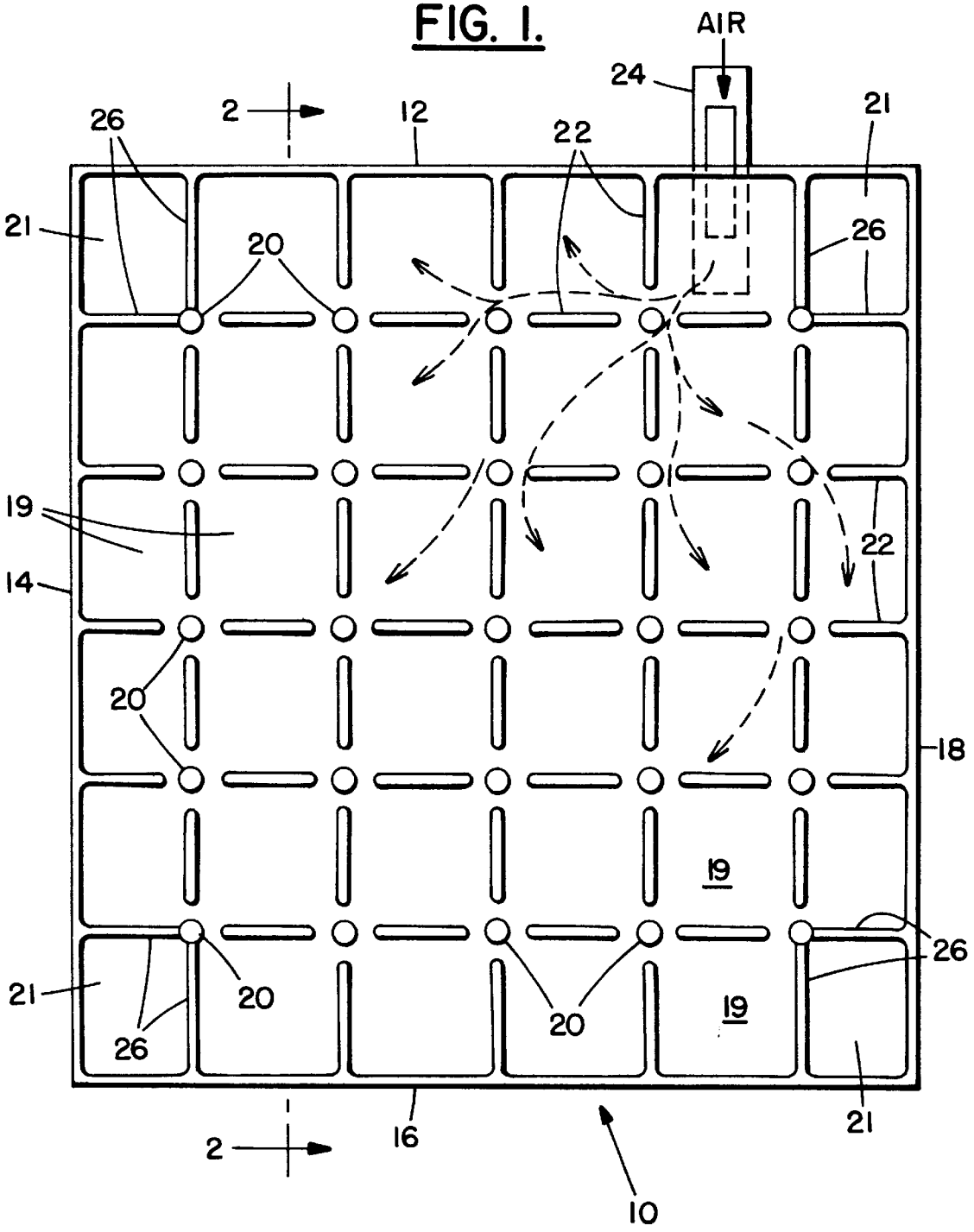
FIG. 1 is a plan view of the packaging cushion of the present invention in its unfolded condition.
Figure 2:
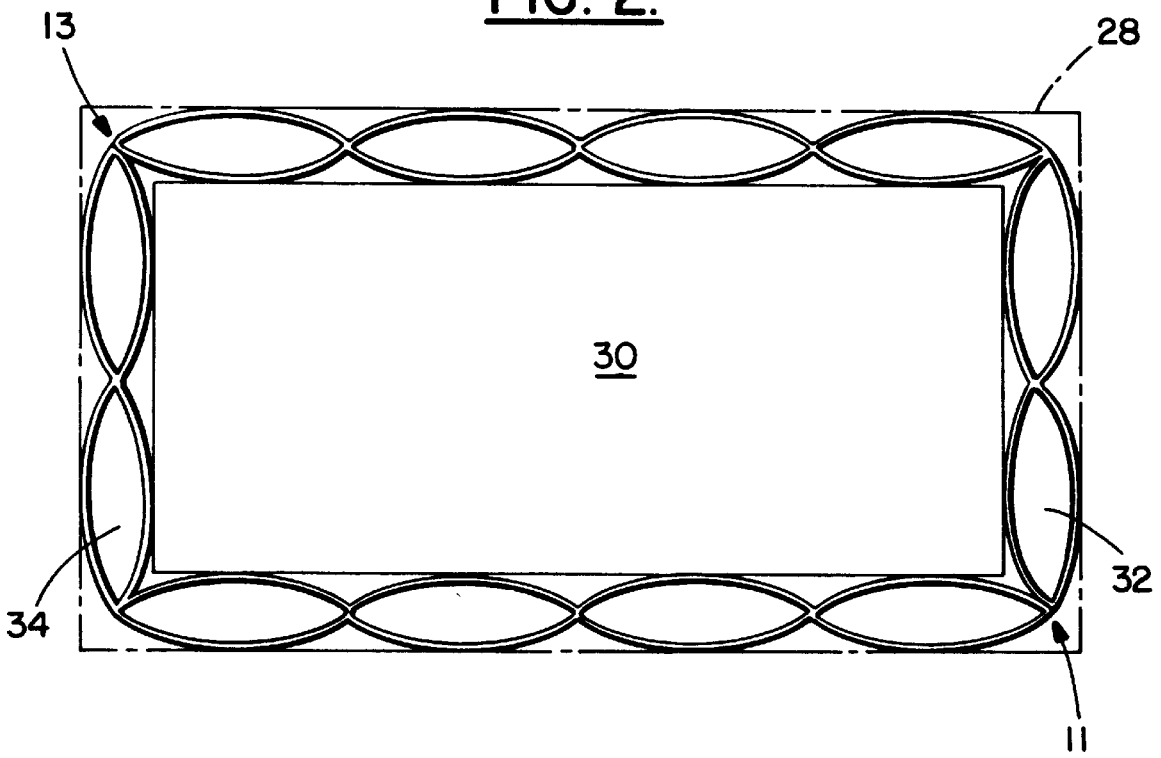
FIG. 2 is a cut away side view of the packaging cushion of FIG. 1 used to surround a product.

Referring now to the drawings and more particularly to FIGS. 1 and 2, numeral 10 designates the inflatable cushion of the present invention which is formed of two sheets of material in the form of a square or rectangle. The sheets may be of any plastic or other suitable material that is flexible, pliable, and impervious to air. The two sheets are fused togethere along their four outer edges 12, 14, 16 and 18 in order to form an air impermeable envelope. The sheets are also fused in a grid pattern forming columns and rows of individual compartments 19. The fusing occurs at spots 20 and segmented seams 22 which form the sides of the various compartments.

Because the seam segments 22 do not extend to their respective spots, but rather leave an unseamed opening between segment end and spot, air injected through a valve 24 is permitted to flow through and into all the compartments except the four corner ones. It is seen that the seam segments 26 at the four corner compartments 21 extend to the spot 20 of each of the corner compartments and as a result the latter will not fill with air but rather will remain deflated. Thus, when air is injected, the cushion will inflate in that all the compartments except the four corners will receive air and become inflated.

Referring now to FIG. 2, there is shown a package ready for shipment comprising an outer container 28 and a product 30, which is to be shipped and protected from damage during shipment. The packaging cushion 11, is positioned below package 30 with the four marginal series of compartments folded upward. Numerals 32 and 34 designate the two marginal columns of the cushion in their upward folded position to protect sides of the product 30. Similarly, the two marginal rows are folded upward to protect the other two product sides. The central array of sixteen compartments serves to support the bottom of the product. It is understood that the deflated condition of the corner compartments facilitate the upward orientation of the line of compartments along each of the four margins of the cushion. As a result, the package 30 is protected at its bottom by the flat array of inflated compartments. The four sides of product 30 are protected by the four marginal rows and columns of compartments extending upward as represented by marginal columns 32 and 34 in FIG. 2. The assemblage is completed by a second cushion 13 similar to cushion 10 located between the top of the product 30 and container 28. The cushion 13 has its marginal series of compartments folded downward to complete coverage of the sides of product 30.

It is seen then that the product 30 within its shipping container 28 is secured in place along its bottom, top and four sides by the inflatable cushions 11 and 13. The product then is securely held in place by cushioning elements fully surrounding it within its container and safe shipment will result with the product protected during transportation.

Figure 3:
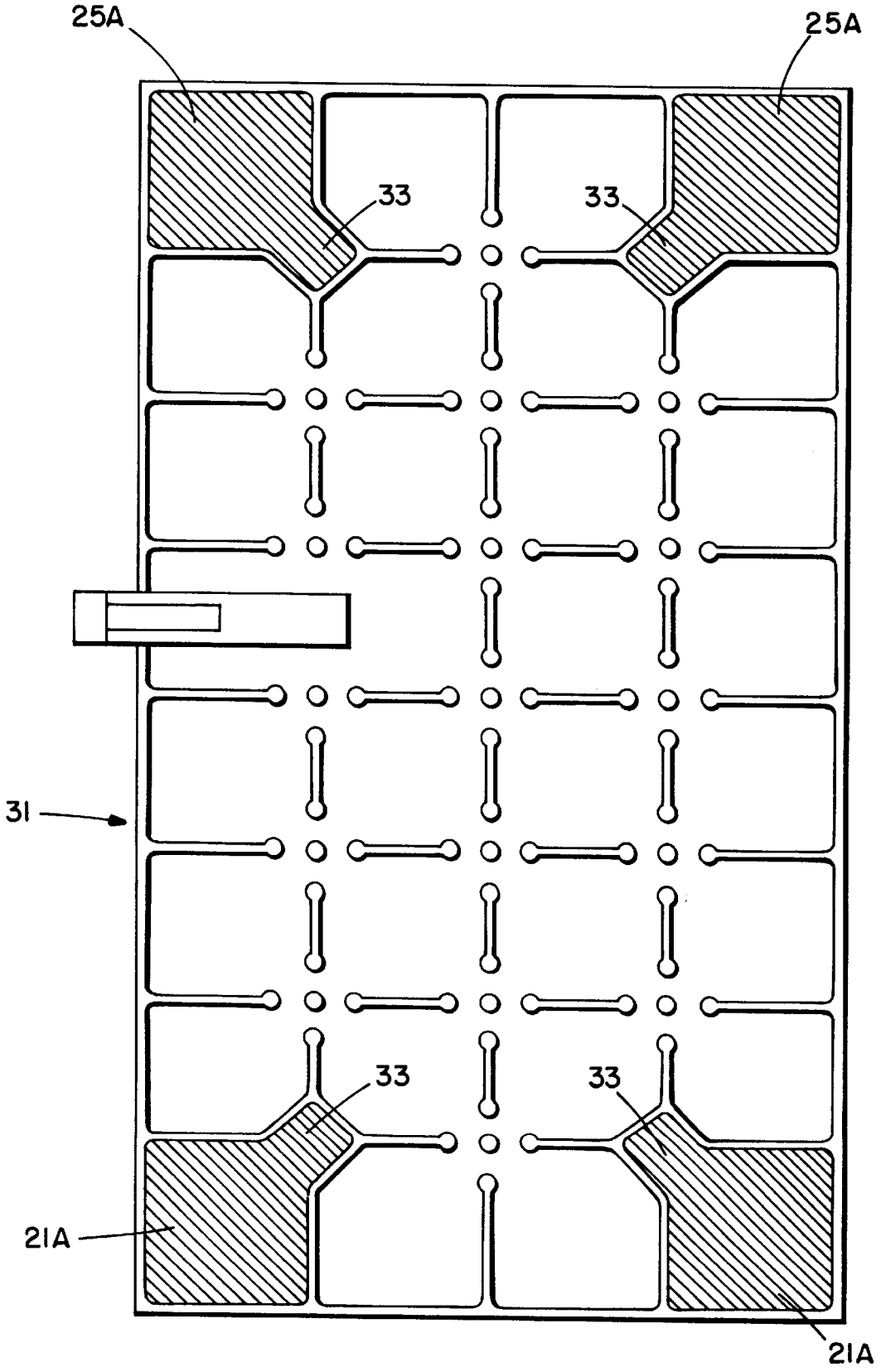
FIG. 3 is a modification of the embodiment of FIG. 1 in which corner compartments are extended.

Referring now to FIG. 3 there is a shown a cushion 31 similar to that of FIG. 1. The number of columns and rows of compartments are different in FIG. 2 to accomodate a different size product. An important feature of the FIG. 2 cushion is the extention of the corner pockets. It is seen that each corner 21A has a tab 33 extending inward from its inner corner which is an extention of the respective noninflatable corner compartments. These noninflatable tab sections will contact the pointed corners of square or rectangular products located within the cushion 31. The advantage of the tabs is that any tendency of the product corners to pierce the cushion will not result in deflation of the cushion.

Figure 4:
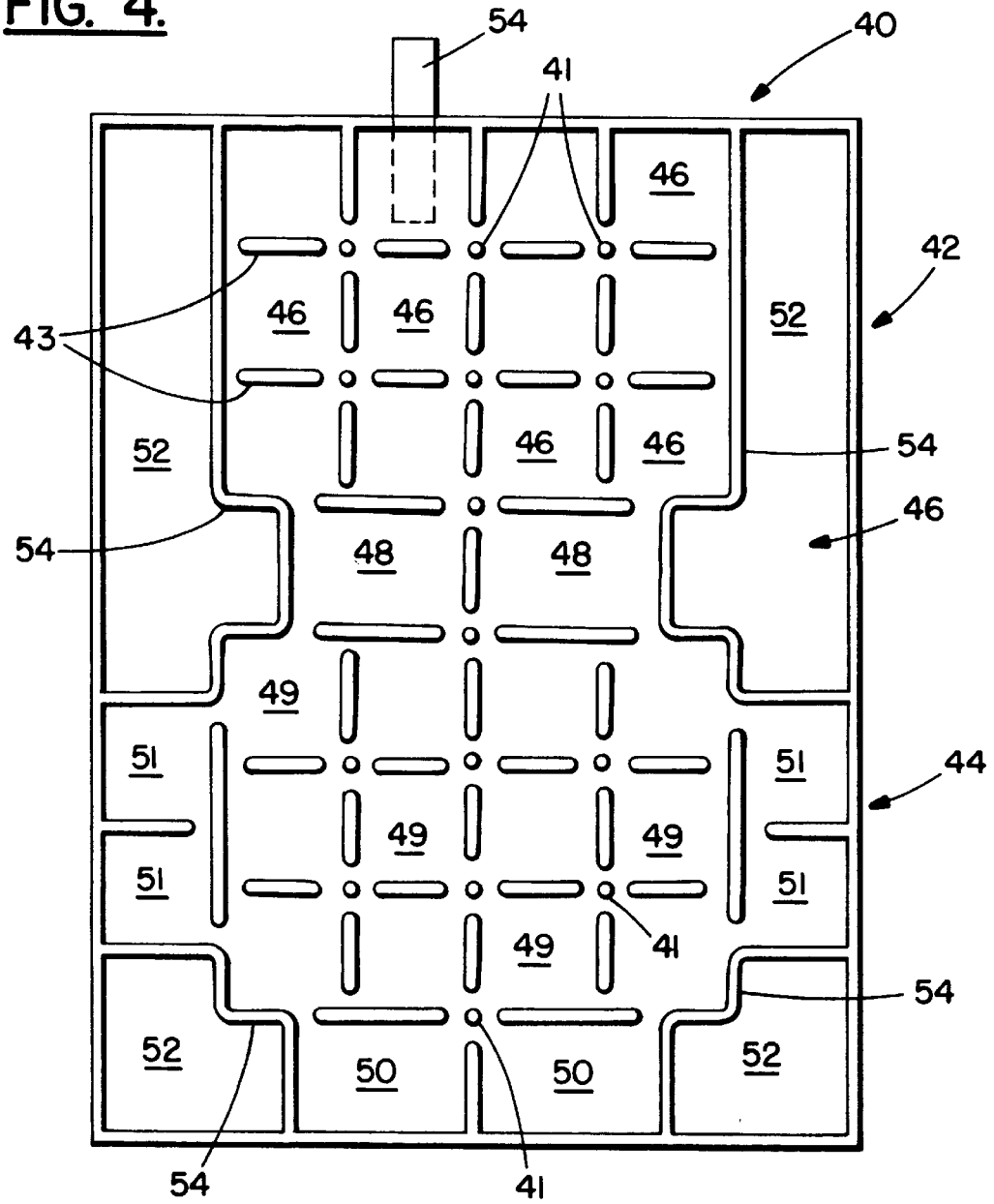
FIG. 4 is a plan view of a modified embodiment of the inflatable cushion of FIG. 1.
Figure 5:
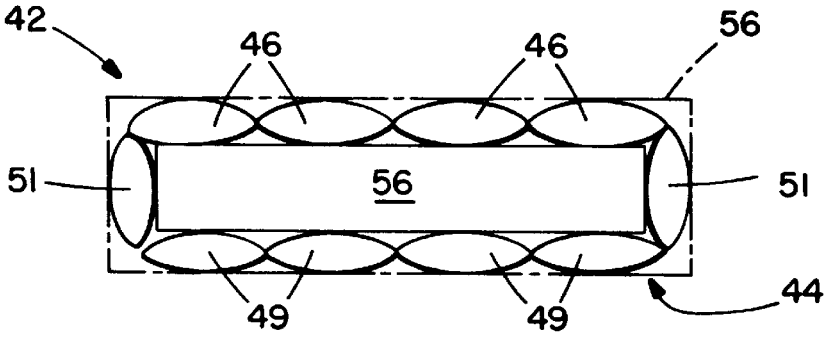
FIG. 5 is a side view of the inflatable cushion of FIG. 3 in place around a product.

Referring now to FIGS. 4 and 5, there is shown another embodiment of the present invention. Numeral 40 represents an inflatable cushion fabricated of two sheets of plastic or other material as in the embodiment of FIG. 1. The two sheets are sealed at spots 41 and seams 43 resulting in a grid of rows and columns of compartments.

The cushion 40 may be considered to be formed of an upper portion 42 and a lower portion 44. The upper portion 42 has twelve compartments 46 and two marginal compartments 48 which connect to the lower cushion portion 44. The latter has twelve compartments 49 and marginal compartments 50 and 51.

The four corners 52 of cushion 40 each have continuous inner seams 54 to prevent the corners from inflating in a manner similar to the four corners of the embodiment of FIG. 1.

A valve 54 is provided similar to the valve 24 of FIG. 1 to inject air into the compartments. Because compartments 46, 48, 49 and 50 all connect, they will inflate upon injection of air through valve 54. Corner compartments 52 being sealed off by seams 54 will remain deflated at all times.

FIG. 4 illustrates the cushion 40 of FIG. 3 in place surrounding the product 56 which is to be transported or shipped and cushioned to avoid breakage.

The portion of the cushion designated 42 is folded over the top of product 56 in a manner such that the array of compartments 46 are over the top as shown in FIG. 4. The portion of the cushion designated 44 has its compartments 48 protecting the bottom of the product and its edge compartments 50 protecting the left and right edges. Not seen in FIG. 4 are marginal compartments 48 protecting the back edge of the product and compartments 50 the front edge.

It is seen then that the product is secured in place within its shipping container 56 and fully protected by the surrounding cushioning and protected during transportation.

Figure 6:
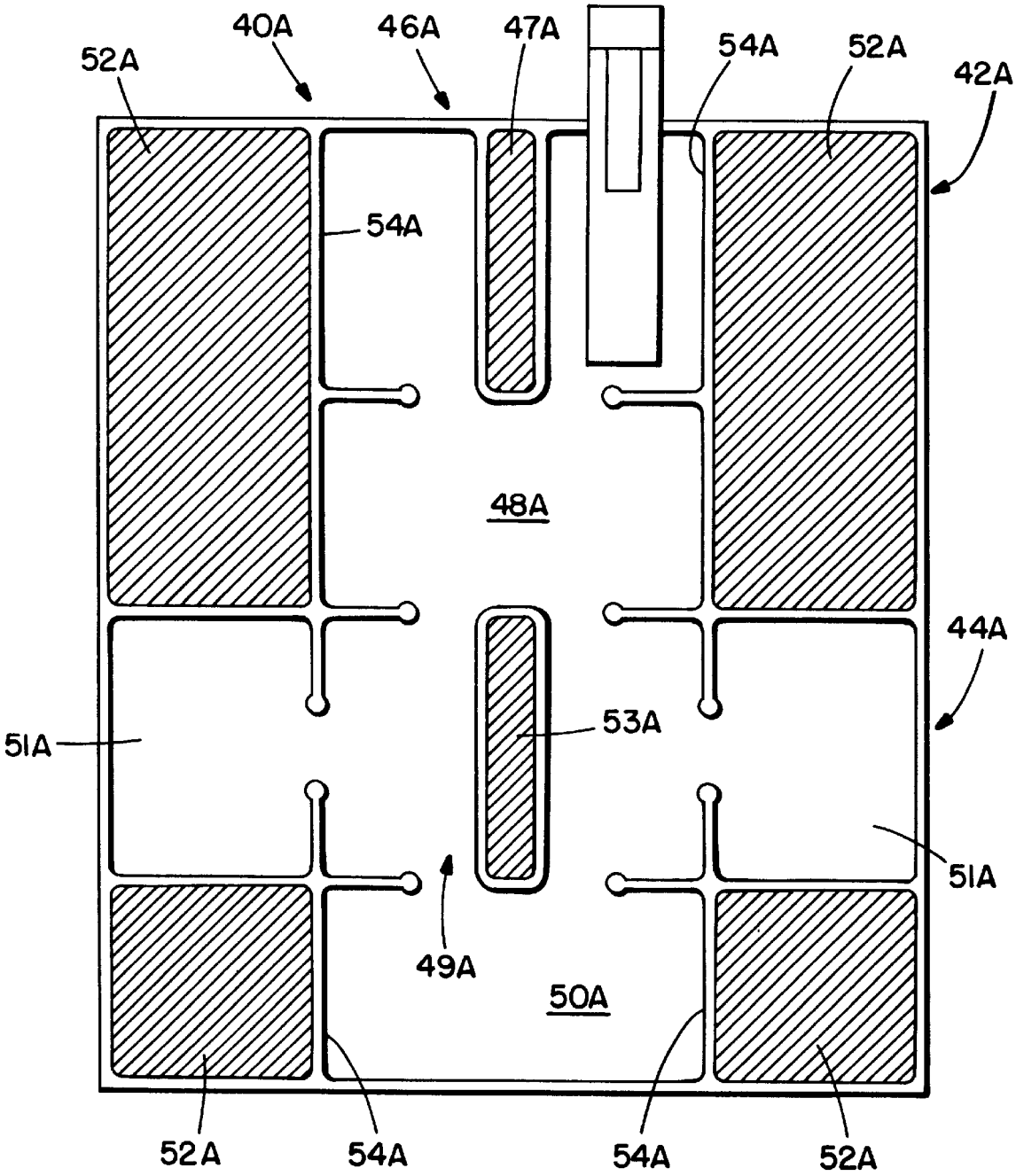
FIG. 6 is a modification of the embodiment of FIG. 4 in which the top and bottom cushion surfaces have noninflatable sections.

Referring now to FIG. 6 there is shown a cushion 40A somewhat similar to cushion 40 of FIG. 4 in that it is designed to fully surround a product although it has a different number of columns and rows of individual compartments than the FIG. 4 embodiment.

Thus FIG. 6 has an upper portion 42A and lower portion 44A corresponding to upper and lower portions 42 and 44 respectively of FIG. 4. The upper portion 42A has one central compartment 46A and a marginal compartment 48A which connects to the lower cushion portion 44A. The latter has a central compartment 49A and marginal compartments 50A and 51A.

The four corners 52A of cushion 40A each have continuous inner seams 54A to prevent the corners from inflating in a manner similar to the four corners of FIG. 4.

A particular feature is that compartment 46A which will overlay the top of a protected product has a noninflatable portion 47A. Similarly compartment 49A that may cushion the bottom of a product has a noninflatable portion 53A. In this manner the size of the inflated portions of compartments 46A and 49A may be predetermined or adjusted by selecting smaller or larger noninflated portions 47A and 53A. Thus the cushioning effect of the top and botton of the inflated cushion can be adjusted by selecting the size of the noninflated portions. This selection is made in accordance with the size, weight and other physical characteristics of the product to be protected.

Having thus described the invention with particular reference to the preferred forms thereof, it will be obvious that various changes and modifications may be made therein without departing from the spirit and scope of the invention as defined in the appended claims.

What is claimed is:

1. An inflatable packaging cushion comprising:

two substantially air impermeable rectangular sheet means of substantially equal size;

sealing means joining said two sheet means along their peripheries to form an impermeable rectangular cushion;

valve means secured to said cushion to permit air to enter and exit therefrom;

means forming a plurality of compartments within the cushion in a rectuangular grid of columns and rows;

said grid of columns and rows including marginal compartments, a central array of compartments and four corner compartments;

air passages connecting said central array of compartments and columns and rows of marginal compartments whereby air injected through said valve means will inflate said compartments;

said corner compartments being sealed to remain in a deflated condition whereby the rows and columns of marginal compartments may be folded at substantially right angles to the central array of compartments.

2. The inflatable packaging cushion set forth in claim 1 in which said marginal compartments include two columns of compartments and two rows of compartments.

3. The inflatable packaging cushion set forth in claim 1 in which each corner compartment has a tail extention extending inward from the inner corner of the compartment.

4. An inflatable packaging cushion comprising:

a pair of substantially air impermeable sheet means of equal size;

sealing means joining said pair of sheet means along their peripheries to form an impermeable air cushion;

valve means secured to said cushion to permit air to enter and exit therefrom;

means forming a plurality of compartments within the inflatable cushion;

said pair of sheet means being in the shape of contiguous first and second rectangles;

the compartments in said first rectangle forming a grid of columns and rows including marginal compartments, a central array of compartments and corner compartments;

air passages connecting said central array of compartments and marginal compartments;

said corner compartments being individually sealed in a deflated condition;

the compartments in said second rectangle forming a grid of columns and rows including marginal compartments, a central array of compartments and corner compartments;

air passages connecting the central array of compartments and marginal compartments in said second rectangle and connected to the air passages om said first rectangle;

said marginal columns and rows of said first rectangle being adapted to be folded at right angles to said central array of compartments and said second rectangle being adapted to be folded over to a position parallel to the central array of compartments of said first rectangle.

5. An inflatable packaging cushion comprising:

two substantially air impermeable rectangular sheet means of substantially equal size;

sealing means joining said two sheet means along their peripheries to form an impermeable rectangular cushion;

valve means secured to said cushion to permit air to enter and exit therefrom;

means forming a plurality of compartments within the cushion in a rectangular grid of columns and rows;

said grid of columns and rows including marginal compartments, a pair of central compartments and four corner compartments;

air passages connecting said pair of central compartments and columns and rows of marginal compartments whereby air injected through said valve means will inflate said marginal compartments and at least a portion of each of said pair of central compartments;

said corner compartments being sealed to remain in a deflated condition whereby the rows and columns of marginal compartments may be folded at substantially right angles to the central array of compartments ; and each of said pair of central compartments having a portion sealed off from the remained of the respective compartment whereby the said portion is noninflatable.

6. The inflatable packaging cushion set forth in claim 5 in which said pair of central compartments are separated by a marginal compartment.

* * * * *